US006877430B2

(12) United States Patent
Müller et al.

(10) Patent No.: US 6,877,430 B2
(45) Date of Patent: Apr. 12, 2005

(54) GRIPPER DEVICE IN A SHEET-PROCESSING MACHINE

(75) Inventors: Volker Müller, Eppingen (DE); Hendrik Frank, Heidelberg (DE); Manfred Gross, Dossenheim (DE); Karl-Heinz Helmstädter, Heidelberg (DE); Hans-Peter Hiltwein, Waghäusel (DE); Michael Krüger, Edingen-Neckarhausen (DE); Siegfried Kurtzer, Edingen-Neckarhausen (DE); Jürgen Maass, Wiesloch (DE); Thomas Schaeffer, Mauer (DE); Rolf Spilger, Viernheim (DE); Norbert Thünker, Hirschberg (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 10/657,315

(22) Filed: Sep. 8, 2003

(65) Prior Publication Data

US 2004/0089178 A1 May 13, 2004

(30) Foreign Application Priority Data

Sep. 6, 2002 (DE) ..... 102 41 282

(51) Int. Cl.[7] ..... B41F 21/04; B65H 5/14

(52) U.S. Cl. ..... 101/490; 271/277

(58) Field of Search ..... 101/246, 409, 101/410, 411, 412; 271/82, 85, 268, 277

(56) References Cited

U.S. PATENT DOCUMENTS

| | | | | | |
|---|---|---|---|---|---|
| 4,667,952 | A | * | 5/1987 | Jeschke et al. | 271/277 |
| 4,718,342 | A | * | 1/1988 | Raab et al. | 101/409 |
| 4,813,353 | A | | 3/1989 | Raab et al. | 101/410 |
| 5,024,432 | A | * | 6/1991 | Thunker et al. | 271/268 |
| 5,333,547 | A | | 8/1994 | Pfisterer et al. | 101/409 |
| 5,431,099 | A | | 7/1995 | Maass et al. | 101/408 |
| 5,749,572 | A | | 5/1998 | Fricke et al. | 271/268 |
| 5,884,561 | A | | 3/1999 | Thünker et al. | 101/409 |
| 6,048,297 | A | * | 4/2000 | Lange et al. | 493/424 |
| 2002/0063383 | A1 | | 5/2002 | Thunker et al. | 271/267 |

FOREIGN PATENT DOCUMENTS

| | | | |
|---|---|---|---|
| DE | 1 159 471 | | 12/1963 |
| DE | 36 32 769 | C2 | 4/1988 |
| DE | 39 02 605 | A1 | 8/1990 |
| DE | 39 19 088 | A1 | 12/1990 |
| DE | 42 00 406 | C2 | 7/1993 |
| DE | 42 33 422 | C1 | 1/1994 |
| DE | 43 07 712 | C1 | 2/1994 |
| DE | 42 33 867 | C2 | 4/1994 |
| DE | 196 13 963 | C2 | 10/1997 |
| DE | 299 12 790 | U1 | 10/1999 |
| DE | 101 50 838 | A1 | 5/2002 |
| EP | 0 775 576 | B1 | 5/1997 |
| GB | 2 050 312 | A | 1/1981 |
| GB | 2 234 318 | A | 1/1991 |
| JP | 11-207926 | * | 8/1999 |

* cited by examiner

*Primary Examiner*—Stephen R. Funk
(74) *Attorney, Agent, or Firm*—Laurence A. Greenberg; Werner H. Stemer; Ralph E. Locher

(57) ABSTRACT

A gripper device in a sheet-processing machine includes a gripper, a gripper pad associated with the gripper and a first drive for moving the gripper out of an opened position thereof into a closed position thereof. The gripper is cooperatively engageable with the gripper pad for producing a clamping force for holding sheets being processed. A second drive is separately operable from the first drive during a production printing operation of the sheet-processing machine. The first and second drives are operable for positioning the gripper and/or the gripper pad so that clamping faces of one of the gripper and/or the gripper pad are movable by the second drive perpendicularly to clamping faces of the other of the gripper and/or the gripper pad.

18 Claims, 4 Drawing Sheets

GRIPPER DEVICE IN A SHEET-PROCESSING MACHINE

BACKGROUND OF THE INVENTION

Field of the Invention

The invention relates to a gripper device in a sheet-processing machine, more particularly a sheet-fed rotary printing press, as well as to a sheet-processing machine having a gripper device. The gripper device has a gripper movable by a drive from an opened position into a closed position. The gripper is cooperatively engageable with a gripper pad associated therewith for producing a clamping force for holding sheets.

In sheet-fed rotary printing presses, the paper sheets to be printed are taken from a sheet pile and, with the aid of grippers, transported through the individual printing units of the printing press, for printing the sheets with one, two or more colors. In that regard, the grippers are mounted in a conventional manner on gripper shafts, which are disposed in a channel formed in the periphery of the respective cylinders of the printing press which transport the sheets through the machine.

In order to be able to compensate for differences in the clamping forces of the respective grippers, which can result from slight deviations or thicknesses of the grippers or the gripper pads assigned thereto relative to one another along a gripper shaft, the grippers are supported, respectively, on the gripper shaft via spring-elastic or resilient elements.

A problem resulting therefrom is that, in particular at high production-printing speeds, bouncing of the grippers can occur, leading to a disruption in the paper run or travel or to an impairment of the printed image.

Furthermore, a problem resulting with conventional sheet-fed rotary printing presses, is that, because the grippers are swivelably or pivotably mounted on the gripper shaft and, due to the swiveling or pivoting movement when the grippers are being closed, no parallel approach is attained between the clamping face of the gripper and the clamping face of the gripper pad assigned thereto. Consequently, a force component acting in the sheet longitudinal direction is formed leading to a so-called "pushing" of the grippers on the paper, which impairs the printing quality and is accompanied by increased wear.

Furthermore, in heretofore known sheet-fed rotary printing presses, there occurs a problem that the holding forces or clamping forces applied by the grippers during the operation of the printing press cannot be varied continuously and, in addition, cannot be adjusted from gripper to gripper over the width of the printing press. A resultant difficulty is that impairment of the printed image caused, for example, by one-sided pushing of the sheets because of an excessively low clamping force in one group of grippers in a row of grippers, cannot be corrected during operation. Furthermore, during the operation of the printing press, it is not possible to change over between high forces during the printing operation with inking units engaged, on the one hand, and low clamping forces during the operation without ink, on the other hand. Finally, there results likewise no possibility of adapting the clamping forces as a function of speed during the production printing operation of the printing press.

Furthermore, in the case of sheet-fed rotary printing presses of the prior art, wherein the gripper pads are not constructed so as to be vertically adjustable, the deformations of the sheet may occur in the region of the grippers, because no adaptation to the paper thickness, respectively, being processed is possible.

German Patent DE 42 00 406 C2, corresponding to U.S. Pat. No. 5,333,547, discloses, on a sheet-processing rotary printing press, a gripper device having a plurality of grippers disposed over the sheet width, which are operable by a control device via an opening and closing mechanism. The control device includes at least one measured value transmitter, a computer and at least one motor. When angular positions prescribed by the computer are reached, the grippers are operated individually and independently of one another via the associated or appertaining opening and closing mechanism driven by the motor.

European Patent EP 0 775 576 B1, corresponding to U.S. Pat. No. 5,749,572, describes a gripper control system for a cyclically oscillatingly driven pre-gripper for the individual transport of sheets in a sheet-fed rotary printing press. The pre-gripper is held at a free end of a rocking lever which is swivelable about a shaft fixed to the frame and has at least one sheet gripper. The sheet gripper is forcibly movable by cams about a joint axis aligned parallel to the rocker shaft for the purpose of closing and opening, during the sheet acceptance and sheet transfer, one of the cams rotating with a single revolution, and the other cam being swivelably mounted on a locally fixed roller lever.

SUMMARY OF THE INVENTION

It is accordingly an object of the invention to provide an alternative gripper device in a sheet-processing machine and a sheet-processing machine having a gripper device, which overcome the hereinafore-mentioned disadvantages of the heretofore-known devices of this general type.

With the foregoing and other objects in view, there is provided, in accordance with the invention, a gripper device in a sheet-processing machine. The gripper device comprises a gripper, a gripper pad associated with the gripper, and a first drive for moving the gripper out of an opened position thereof into a closed position thereof. The gripper is cooperatively engageable with the gripper pad for producing a clamping force for holding sheets being processed. A second drive is separately operable from the first drive during a production printing operation of the sheet-processing machine. The first and second drives are operable for positioning at least one of the gripper and the gripper pad so that clamping faces of the at least one of the gripper and the gripper pad are movable by the second drive perpendicularly to clamping faces of the at least other of the gripper and the gripper pad.

In accordance with another feature of the invention, the second drive is a piezo-actuator drive.

In accordance with a further feature of the invention, the gripper, in the closed position thereof, is positioned locally in a fixed position with respect to the gripper pad by the first drive. The gripper pad is movable relative to the gripper by the second drive for clamping the sheets with the gripper closed.

In accordance with an added feature of the invention, the gripper device further includes a gripper shaft whereon the gripper is mounted fixed against rotation relative thereto. The gripper shaft is lockable in the closed position by the first drive.

In accordance with an additional feature of the invention, the first drive is formed by a rotary drive actable upon the axis of rotation of the gripper shaft for locking, by a stoppage torque thereof, the gripper shaft in the closed position.

In accordance with yet another feature of the invention, the first drive is formed by a linear drive actable via a lever upon the axis of rotation of the gripper shaft for locking, by a stoppage torque of the linear drive, the gripper shaft in the closed position.

In accordance with yet a further feature of the invention, the gripper device further includes a self-locking mechanism via which the first drive is coupled with the gripper for locally fixed positioning of the gripper in the closed position.

In accordance with yet an added feature of the invention, the self-locking mechanism includes a toggle-lever mechanism.

In accordance with yet an additional feature of the invention, the gripper device further includes a further drive for varying the position of the gripper shaft relative to the gripper pad.

In accordance with still another feature of the invention, the gripper is movable by the first drive with respect to the gripper pad out of the opened position and into the closed position in a plane extending at least approximately parallel to a transport plane of the sheets.

In accordance with still a further feature of the invention, the first drive is a piezo-actuator.

In accordance with still an added feature of the invention, the second drive includes a piezo-actuator whereon the gripper pad is disposed.

In accordance with still an additional feature of the invention, the piezo-actuator is formed by a multiplicity of individual piezo-elements disposed in a stack-shaped manner.

In accordance with another feature of the invention, the gripper pad is positionable locally fixed, and the first drive and the second drive are mechanically coupled with the gripper for moving the gripper out of the opened position and into the closed position by the first drive, and for moving the gripper into the closed position by the second drive for clamping the sheets at least approximately perpendicularly to the gripper pad.

In accordance with a further feature of the invention, the gripper is swivelable about a swivel point. The second drive is actable upon the swivel point for varying the position of the swivel point.

In accordance with an added feature of the invention, the gripper device further includes a programmable electronic control device for operating the first and the second drive.

In accordance with an additional feature of the invention, the gripper device further includes a sensor coupled with the control device for measuring a clamping force actable between the gripper and the gripper pad. The second drive is movable via the control device in accordance with signals from the sensor for varying the spaced distance between the gripper pad and the gripper.

In accordance with yet another feature of the invention, the sensor is accommodated on the gripper pad.

In accordance with yet a further feature of the invention, the electronic control device serves for moving the second drive as a function of the signals from the sensor. This is done for actively counteracting bouncing of the gripper during the closing operation by effecting a relative change in the distance between the gripper and the gripper pad.

In accordance with yet an added feature of the invention, the gripper pad is lowerable by the second drive during closure of the gripper.

In accordance with yet an additional feature of the invention, the gripper device further includes at least another gripper so as to form a plurality of grippers. The plurality of grippers have appertaining gripper pads disposed along a row of grippers. The grippers and the appertaining gripper pads along the row of grippers are to be disposed alternatingly offset relative to one another by the first drive and the second drive during production printing operation for forming a corrugation in the gripped edge of a respective sheet.

In accordance with another feature of the invention, the gripper device further includes at least another gripper for forming a plurality of grippers having appertaining gripper pads disposed along a row of grippers on an upstream sheet-guiding cylinder, as viewed in sheet transport direction. A plurality of further grippers have appertaining gripper pads being disposed along a further row of grippers on a downstream sheet-guiding cylinder. The grippers and the appertaining gripper pads of the upstream cylinder are movable by the first drive and the second drive relative to the grippers and the gripper pads of the downstream cylinder during production printing operation as a function of the thickness of a sheet being processed, so that the edge of the sheet extends rectilinearly during sheet transfer.

With the objects of the invention in view, there is also provided a sheet-processing machine, comprising a gripper device including a gripper, a gripper pad associated with the gripper, and a first drive for moving the gripper out of an opened position thereof into a closed position thereof. The gripper is cooperatively engageable with the gripper pad for producing a clamping force for holding sheets being processed. A second drive is separately operable from the first drive during a production printing operation of the sheet-processing machine. The first and second drives are operable for positioning at least one of the gripper and the gripper pad so that clamping faces of the at least one of the gripper and the gripper pad are movable by the second drive perpendicularly to clamping faces of the at least other of the gripper and the gripper pad.

Thus, according to the invention, a gripper device in a sheet-processing machine includes a gripper cooperating with an associated gripper pad for producing a clamping force for holding the sheet at a leading edge or trailing edge thereof and which is movable out of an opened position into a closed position by a first drive. The gripper or the gripper and the gripper pad are, in this regard, positioned, in a manner according to the invention, by the first drive and a second drive operable separately from the first drive during a production printing operation of the sheet-processing machine. Thus a path of movement of the gripper relative to the gripper pad is achieved which is optimized with regard to bouncing or rebounding of the gripper and pushing or sliding of the processed sheets.

Although the invention may be described hereinbelow with reference to only one gripper for easier understanding, that which is stated herein preferably applies in a corresponding manner to the entire number of grippers disposed across the width of the printing press, for example on a gripper shaft.

According to a preferred embodiment of the invention, in the closed position, each of the grippers is positionable locally fixed with respect to the gripper pad by the first drive. It is advantageous that all the grippers of a gripper bar be firmly held on a gripper shaft so as to rotate therewith, and the entire gripper shaft as a whole can be rotated out of the opened position of the grippers into the closed position by the first drive. In this embodiment of the invention, in a manner according to the invention, each gripper pad has its own second drive assigned thereto, by which the gripper pad is preferably movable rectilinearly relative to the gripper in order to clamp the sheets after the gripper has been positioned locally fixed in the closed position by the first drive. The action of driving the first drive and/or the respective second drive can be carried out, for example, by cams or similar devices. The action of driving the first drive and/or the respective second drive is preferably carried out via an electronic control device which, as a function of the angular degree setting or position of the printing press, moves the corresponding drives in an accurately positioned manner. The individual positions of the first drive and/or of the second drive are stored as associated values in a memory belonging to the electronic control device.

This results in the advantage that, by changing the respective values in the memory, a corresponding positional correction of the associated gripper pad can be performed even during production printing operation of the printing press or can be performed automatically as a function of a measured speed value likewise measured by the control device automatically as the printing press is run up or in the event of a speed change, without requiring any manual intervention by the printer for this purpose.

According to a first embodiment of the invention, swiveling the gripper shaft forwardly and backwardly in order to open and close the grippers can be carried out by a rotary drive, for example a stepping motor or a linear drive, and a corresponding lever mechanism. The motor forms the first drive and the gripper shaft is preferably locked in the closed position by the stoppage torque of the motor, which is produced by appropriately energizing the motor. In this way, the gripper shaft and, as a result, also the grippers firmly connected thereto, can be positioned during the production printing operation of the press in an optimum manner with regard to closing the grippers, holding the sheets and opening the grippers.

The hereinafore-described configuration of the invention with a rotary drive or linear drive, wherein the gripper shaft is locked by appropriately energizing the drive motor by the stoppage torque thereof, results in the advantage that no further additional mechanisms are needed to position the gripper shaft in a fixed position. The control can be carried out in a straightforward manner via the electronic control device.

According to a further embodiment of the invention, the first drive is coupled with the gripper via a self-locking mechanism, in order to position the gripper locally fixed in the closed position. The self-locking mechanism is, in this regard, preferably a toggle-lever mechanism, wherein the first lever is fixed by a free end thereof to the base body of an associated or appertaining printing press cylinder or to the frame of the printing press, and the end of the second lever either acts upon the gripper shaft at a spaced distance from the axis of rotation of the gripper or, if an individual first drive is provided for each gripper, acts directly upon the gripper in the manner of a swivel joint. In this embodiment of the invention, the first drive acts upon the articulated connection between the first lever and the second lever of the toggle-lever mechanism so that the first and the second lever of the toggle-lever mechanism extend at least approximately along a line in the closed position of the gripper.

In this embodiment of the invention, the first drive is preferably an electric linear drive, but can also be a conventional electric motor having a rotational movement which is converted by an appropriate crank drive into a linear movement acting upon the central articulated joint of the toggle-lever mechanism via an appropriate further lever.

In the aforedescribed embodiment of the invention, the second drive is preferably formed by a piezo-actuator which, preferably assembled from a large number of individual piezo-elements disposed in a stack-shaped manner, produces a change in the length of the stack due to the application of an appropriate voltage, the alignment of piezo-elements being hereinafter also referred to as a piezo-stack.

Piezo-stacks of this type have become known heretofore from the prior art. The piezo-actuator or piezo-stack is, in this regard, preferably disposed directly underneath the gripper pad, so that the longitudinal axis of the former extends perpendicularly to the plane of the clamping faces of the gripper pad and of the gripper. This results in a very compact construction, wherein the actual clamping forces for clamping the sheet edges during the sheet transport following the closure of the grippers and the locking of the grippers in the closed position are produced by an appropriate change in the length of the piezo-actuator via a corresponding control voltage, which is regulated by the control device and, for example, an amplifier connected downstream.

A further advantage resulting from the use of a piezo-actuator is in the clamping of the sheets being produced by a relative movement of the clamping face of the gripper and of the clamping face of the associated gripper pad which is to a great extent perpendicular, by which point-focal damage to the paper under high clamping forces is avoided.

According to a further embodiment of the invention, the gripper shaft is additionally movable relative to the gripper pad via a further drive, for example an electric motor with an appropriate adjusting mechanism, or an electric linear drive, however, and a magnetorestrictive or magnetorheological actuator, respectively, in order to permit adaptation to or matching the paper thickness. This results in the advantage that, only by two actuators acting at the ends of the gripper shaft, a change in the spaced distance between the clamping faces of all the grippers of a gripper shaft can be performed if, for example, a change is made from a lightweight grammage to pasteboard or cardboard.

According to a further advantageous embodiment of the invention, provision can be made for the gripper not be fixed to a gripper shaft but, by the first drive of the gripper pad, to be moved from the opened position into the closed position in a plane extending at least approximately parallel to the sheet transport plane. In this case, the first drive can be formed by an appropriately constructed and disposed Piezo-actuator which, for example, is fixed to a crossmember, and has a direction of extension at least approximately parallel to the sheet transport plane and has an upper side to which the gripper, formed from a solid material, is fixed directly, so that when a voltage is applied via the control device to the piezo-actuator, a relative displacement of the gripper with respect to the associated clamping face of the gripper pad is achieved. The holding force for holding the paper is also produced, in this case, by an appropriate movement of the second drive connected to the gripper pad, it being additionally possible for a paper thickness adjustment to be provided via a further drive, which is disposed under the first drive or the first drives of a row of grippers, for example on the crossmember, and moves the first drives in a direction perpendicular to the sheet transport plane. This configuration of the invention results in the advantage that the size of the clamping face can also be varied by moving the gripper relative to the gripper pad along a plane extending parallel to the sheet transport plane by the first drive via the control device during the production printing operation of the printing press, in order, for example to optimize the clamping force by simply enlarging the clamping face.

According to a further embodiment of the invention, the gripper pad is mounted firmly on the respective component of the printing press, for example fixed to the base body of a sheet transport drum, and the first and the second drive act mechanically upon the gripper, which, for this purpose, is disposed so as to be swivelable about a swivel point and, by the first drive, is swivelable about this swivel point in order to produce the opening and closing movement. The second drive acts in a manner according to the invention, if appropriate via a suitable mechanism, on the swivel point, in order to displace the latter in the position thereof relative to the gripper pad and, thereby, to move the entire gripper, following the swiveling of the gripper, into the closed position with respect to the gripper pad, in a manner that the clamping faces of the gripper and of the gripper pad move towards one another and clamp the sheet.

This results in the advantage that, in order to introduce the paper, the gripper can be opened wide by being swiveled about the swivel point, so that even sheets with a relatively great amount of waviness of the associated or appertaining sheet edge can be introduced reliably into the opened grippers between the clamping faces of the gripper pad and of the gripper. In connection with the foregoing, the gripper is then swiveled back into the closed position, by operating the first drive, and in this closed position, the clamping faces of the gripper pad and of the gripper extend at least approximately parallel to one another, and then the swivel point is moved, preferably linearly and perpendicularly to the clamping face of the gripper pad, by operating the second drive, in a manner that the spaced distance between the clamping faces of gripper pad and gripper is reduced until the desired clamping force is reached. In this regard, the clamping force can be measured, for example, via an additional sensor which, for example, can be constructed as a pressure-sensitive piezo-element.

In this embodiment of the invention, the first and the second drive are preferably likewise linear drives, for example piezo-actuators, which are preferably likewise constructed as the hereinaforedescribed piezo-stacks. This configuration of the invention results in the advantage that bouncing of the grippers due to the lack of a resilient connection between drive and gripper or drive and gripper pad can virtually completely be eliminated. In the same way, the piezo-actuator in the device according to the invention can advantageously be used actively for oscillation damping, in that, for example, occurring peak forces are compensated for by a corresponding counter-movement.

According to a further embodiment of the invention, the second drive acts upon the gripper via a rocker swivelably mounted on the base body of the printing press cylinder, the spaced distance between the point of action of the first drive and the point of rotation of the rocker preferably being different from the spaced distance between the point of rotation of the rocker and the point of action of the gripper, so that the result is a step up or step down of the forces produced by the first drive, depending upon how great the distances are selected to be. In this regard, even in the case of actuators with small travel movements, the gripper can be swiveled sufficiently far into the opened position, so that an adequate distance between the clamping face of the gripper and the associated or appertaining gripper pad can be ensured when the sheet edges enter this region.

The point of action of the first drive on the rocker, the point of rotation of the rocker, and the point of action of the rocker on the gripper and, preferably likewise also, the swivel point of the gripper, which can be moved by the second drive, in the hereinaforedescribed embodiment of the invention, with the gripper closed, preferably lie on a straight line, which preferably extends parallel to the clamping face of the gripper pad. The spaced distance of the straight line from the clamping face, in this regard, corresponds at least approximately to the height of the gripper, which is preferably U-shaped.

In this embodiment of the invention, use is advantageously made of two linear actuators, for example piezo-actuators, disposed parallel to one another, which, for one, are fixed to the associated or appertaining component of the printing press, for example to the sheet-guiding cylinder and, for another, are swivel-jointly coupled to the gripper element. In the ideal case, the axes of the linear actuators extend parallel to the closing direction. This results in the advantage that, given a synchronous movement of the two actuators, a linear movement of the gripper is achieved, which serves simultaneously for closing the gripper and for applying the respective clamping force to the sheet. Thereby, "pushing" of the clamping face of the gripper is advantageously avoided.

Furthermore, in the case wherein the gripper centerline and the centerline of the two axes of the actuators coincide, the result is advantageous, torque-free application of the holding force.

For the case wherein the two actuators are not moved synchronously, on the other hand, a rotary movement of the gripper results, which serves the purpose of swiveling away from the closed position into the opened position, and the reverse. The magnitude of the swiveling movement depends at least approximately on the spaced distance between the two actuator axes, in addition to the relative travel of the two actuators, and on the spaced distance between the attachment point of the actuators on the gripper and on the clamping face of the gripper.

The tendency of the gripper to bounce can advantageously be reduced to a considerable extent, in this regard, by appropriate adaptation of the path of movement, it being possible for corresponding regulation of the closing force via the control device, for example as a function of the position of the gripper, to be performed by an additional sensor in such a manner that bouncing is actively counteracted.

A further advantage of this embodiment of the invention is to be seen in the fact that complicated precise adjustment of the grippers can be dispensed with because, if a sensor is used for measuring the clamping force, the movement, in particular the movement of the second drive, is preferably regulated as a function of the force.

According to a further embodiment of the invention, the gripper has an L-shaped construction, the swivel point for swiveling the gripper preferably being located at the level of the clamping face of the gripper pad, in the region of the point of intersection of the two legs of the L.

In this embodiment of the invention, the second drive preferably acts at the end of the free leg of the L or bellcrank, the effective direction of the first drive preferably extending parallel to the plane of the clamping face of the gripper pad if the first drive is formed by a linear drive, for example a piezo-actuator or some other conventional linear drive.

The hereinaforedscribed embodiment of the invention offers the advantage that the actions of swiveling pivoting away and closing the grippers can be performed in a completely mechanically decoupled manner. If, for example, the point of action of the second drive on the gripper when the latter is closed is located approximately at the height of the gripper pad, then the result is advantageously vertical lowering of the clamping face of the gripper onto the sheet. Assuming an adequately large spaced distance between the two points of actions or point of rotation of the first and second drive on the gripper, there results the advantage also that a very large holding force can be produced by the second drive because of the lever action.

Other features which are considered as characteristic for the invention are set forth in the appended claims.

Although the invention is illustrated and described herein as embodied in a gripper device in a sheet-processing machine and a sheet-processing machine having a gripper device, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
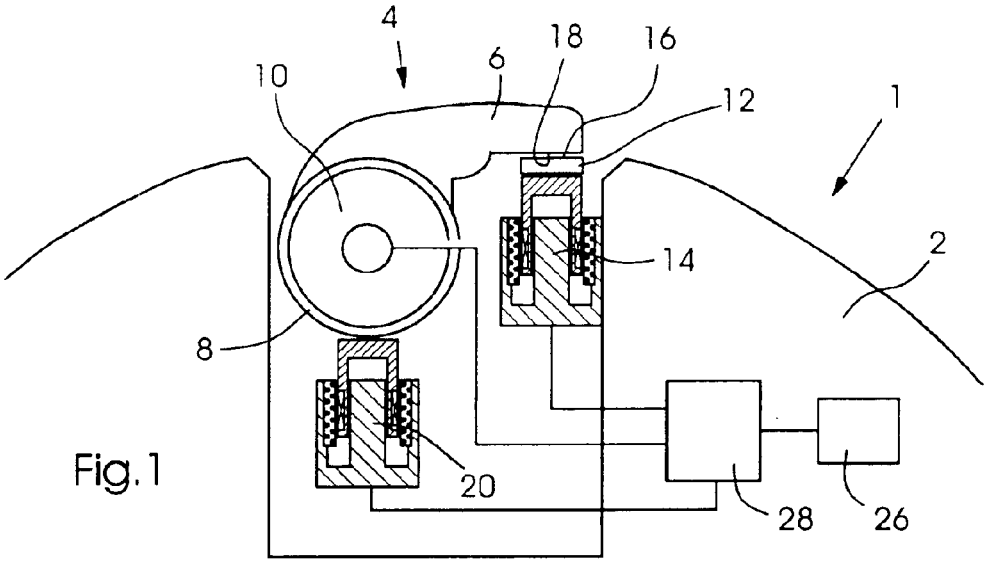
FIG. 1 is a fragmentary, diagrammatic and schematic, partly cross-sectional view of a printing press cylinder provided with a gripper device according to the invention.

Referring now to the figures of the drawings in detail and first, particularly, to FIG. 1 thereof, there is seen a sheet-fed rotary printing press having a sheet-guiding drum or cylinder 1 formed with a base body 2 whereon a gripper device 4 according to the invention is mounted. The gripper device 4 includes a large number of grippers 6, which are firmly connected to a gripper shaft 8 (see also FIG. 2). The gripper shaft 8 is swivelable by a first drive 10 formed as an electric motor, from a closed position of the grippers 6, as shown, into an opened position thereof, which is not specifically illustrated.

As can be ascertained from FIG. 1, the grippers 6 respectively cooperate with a gripper pad 12, which is linearly drivable by a second drive 14 formed as an electromagnetic drive for moving a first clamping face 16 of the gripper pad 12 parallel to a second clamping face 18 of the gripper 6. The movement is in a direction which is at least approximately perpendicular to the clamping faces 16 and 18.

The gripper shaft 8 is movable relative to the gripper pad 12 as a whole via a further drive formed as an electromagnetic linear drive 20. This is done in order to be able to perform a thickness matching to that of the paper format respectively being processed.

Figure 3:
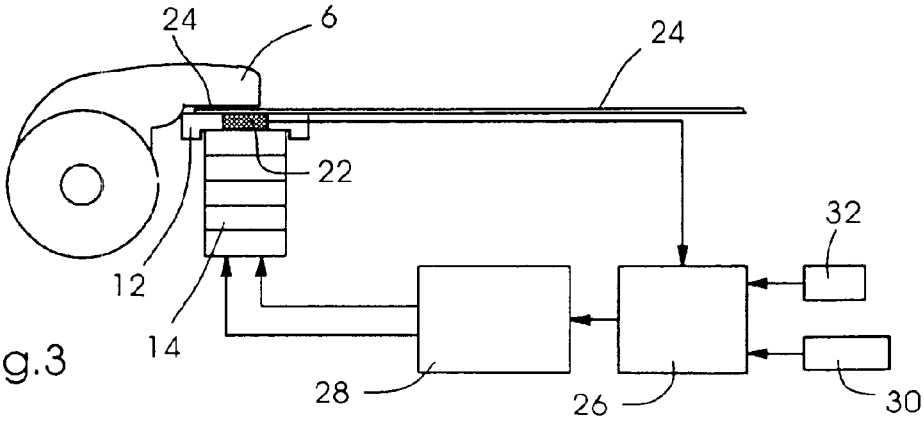
FIG. 3 is a diagrammatic and schematic illustration of a gripper pad, which is movable by a piezo stack, together with an electronic control device associated with the gripper pad.

As is further shown in FIG. 3, in a further embodiment of the invention, the second drive 14 is constructed as a piezo-stack, on the upper side of which, within the gripper pad 12, a preferably piezoelectric sensor 22 is disposed. The sensor 22 measures a compressive force and, therefore, a clamping force exerted on a sheet 24 when the gripper pad 12 is forced into the closed position of the gripper 6 shown in FIG. 3, against the clamping face of the gripper 6, by an appropriate application of an electric voltage to the piezo-stack.

The position of the gripper pad 12 and, therewith, the clamping force applied to the sheet 24, is varied in the preferred embodiment of the invention by an electronic control device 26. The electronic control device 26, via appropriately constructed power electronics 28, applies a voltage corresponding to the respective position of the clamping face of the gripper pad 12 to the piezo-stack of the second drive 14.

The control device 26 preferably includes a microprocessor using prescribed values which, for example, are obtainable from a printing-press tachometer 30 or the like or by an anticipatory control 32 of the printing press. The values are obtained for calculating the appertaining desired or nominal position values for the gripper pad 12 and feeding them to the power electronics 28. That is done in order to move the second drive 14 into the appropriate position until the actual value of the clamping force, which is determined via the force sensor 22, corresponds to the desired or nominal value for the clamping force determined by the control device 26.

The electronic control device 26 controls the positions of the first drive 10 and the further drives 20, respectively, for adjusting the height of the gripper shaft 8 in a corresponding manner via lines which are not otherwise specifically illustrated.

Figure 4:
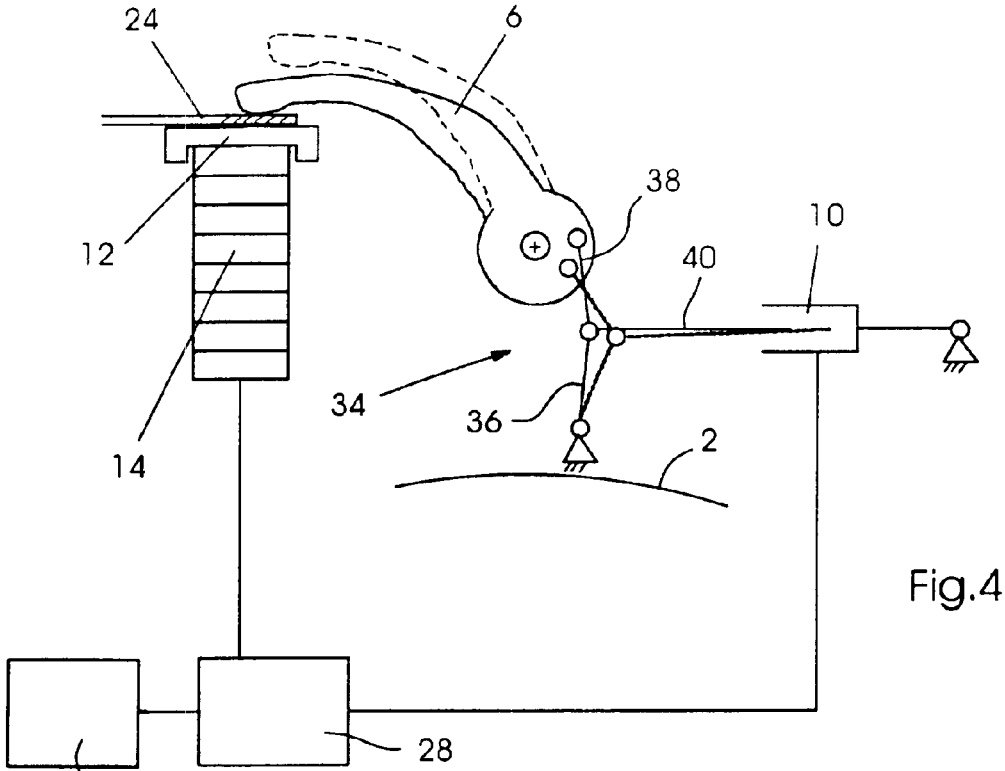
FIG. 4 is a view similar to that of FIG. 3 of a further embodiment of the invention, wherein the gripper is operated by a toggle-lever mechanism.

According to a further embodiment of the invention illustrated in FIG. 4, the first drive 10 is formed by an electric linear drive, preferably a piezo-actuator, which acts upon the gripper 6 via a toggle-lever mechanism 34. The toggle-lever mechanism 34 includes a first lever 36, which is connected articulatedly to the base body 2 of the sheet-guiding cylinder 1 of the printing press, and which is coupled via a further articulated joint to a second lever 38, which is, in turn, disposed articulatedly at a distance from the axis of rotation of the gripper 6. The first drive 10 acts via an at least approximately linearly moved rod or a further lever 40 on the joint connecting the first and second levers 36 and 38 and, thereby, moves the toggle-lever joint 34 out of the closed position, illustrated by solid lines, into the opened position of the gripper 6, illustrated by broken lines. Due to the configuration of the respective swivel joints of the toggle-lever joint 34 on an approximately rectilinearly extending line, the gripper 6, in the closed position, is blocked against unintentional opening and, therefore, against bouncing, so that the clamping forces, which are exerted on the sheet 24 by the first drive 10 after the gripper pad 12 has been moved, can be achieved with a comparatively high degree of accuracy, without the occurrence of any bouncing of the entire device.

Figure 5:
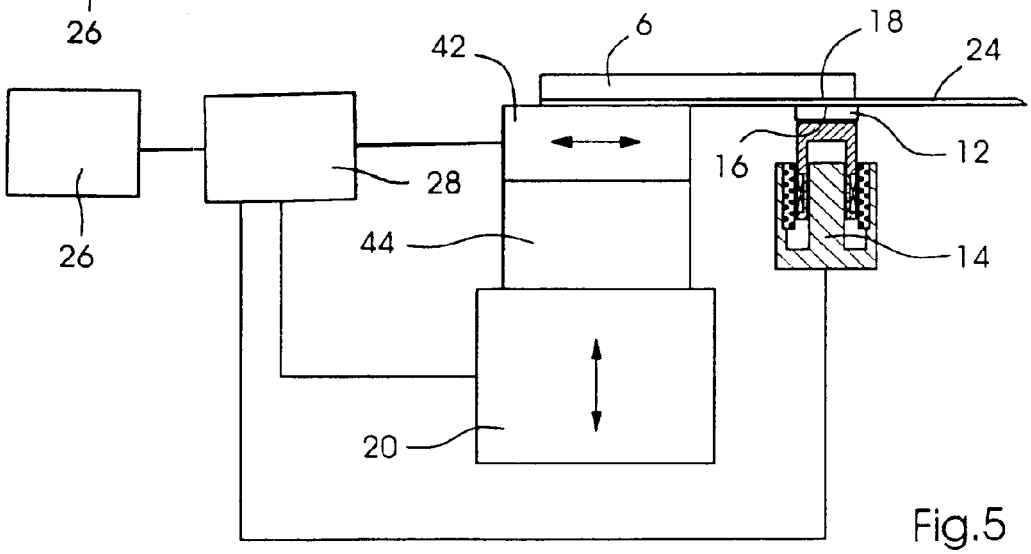
FIG. 5 is a diagrammatic and schematic view of a further embodiment of a gripper device according to the invention, herein the grippers are movable parallel to clamping faces of the gripper pads by a second drive formed as a piezo actuator.

According to the embodiment of the invention illustrated in FIG. 5, the first drive is formed by a piezo-stack or other electric linear drive 42 which, as a result of the application of an appropriate voltage by the control device 26, is movable in a direction parallel to the clamping face 16 of the gripper pad 12, in this case likewise constructed so as to be vertically adjustable. In the opened position, in this embodiment of the invention, the gripper 6 is preferably moved towards the lefthand side in FIG. 5 by the first drive 42 to such an extent that the tip of the gripper 6 close to the sheet is located at a spaced distance from the clamping face 16 of the gripper pad 12. In this position, the clamping face 16 of the gripper pad 12 is preferably positioned, by the second drive 14, as far removed as possible from the appertaining clamping face 18 of the gripper 6, so that the sheet 24 can enter freely into the region formed between the clamping faces 16 and 18, without coming into contact therewith. Only then is the gripper moved to the righthand side in FIG. 5 by the first drive 42 until the clamping face 18 of the gripper 6 is positioned above the clamping face 16 of the gripper pad 12. The gripper pad 12 is then moved by the seconddrive against the appertaining clamping face 18 of the gripper 6 in order to clamp the sheet 24.

Figure 2:
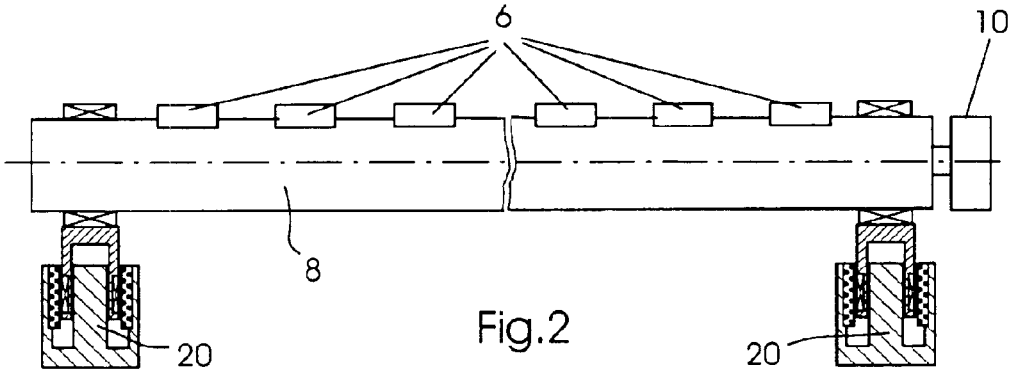
FIG. 2 is a fragmentary, cross-sectional view of the gripper device of FIG. 1 as viewed along A gripper shaft.

In the same manner as for the embodiment of the invention shown in FIGS. 1 and 2, in the embodiment of the invention shown in FIG. 5, a further drive 20, for example in the form of a piezo-stack, can also be provided, with which the distance of the clamping faces 16 and 18 of a whole group of grippers 6 are able to be varied jointly if the grippers 6 are accommodated on a crossmember 44 which, as shown in FIG. 5, preferably extends over the width of the printing-press cylinder 1.

Figure 6:
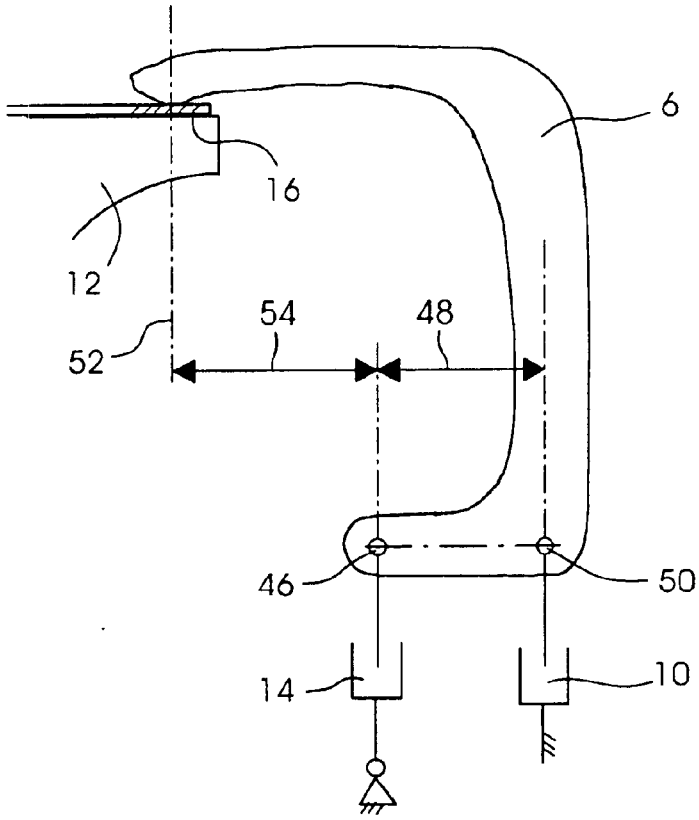
FIG. 6 is a view similar to that of FIG. 4 of yet a further embodiment of the invention, wherein the gripper is swivelable by the first drive about a swivel point which is movable by the second drive.

In the embodiment of the invention shown in FIG. 6, the gripper 6 has the form of a U or double-angled lever which is swivelable by the first drive 10 about a swivel point 46 from a non-illustrated opened position into a closed position shown in FIG. 6. In this regard, the first drive 10 is also preferably formed as a linear drive and acts upon the gripper 6 via an articulated or swivel joint 50 at a spaced distance 48, on a line which, in the closed position, preferably extends parallel to the clamping face 16 of the gripper pad 12. In this embodiment of the invention, the swivel point 46 is movable by the second drive 14, preferably in a direction perpendicular to the clamping face 16 of the gripper pad 12, in order to move the gripper 6, preferably vertically with respect to the clamping face 16, into the closed position of the gripper 6 and to clamp the sheet 24. The spaced distance between the swivel point 46 and an imaginary vertical central connecting line 52 through the clamping face 16 of the gripper pad 12 which, in this case, is firmly connected to the base body of the sheet-carrying cylinder 1, is identified by reference numeral 54 in FIG. 6, and is preferably greater than the distance 48 between the swivel point 46 and the point of action of the swivel joint 50.

Figure 7:
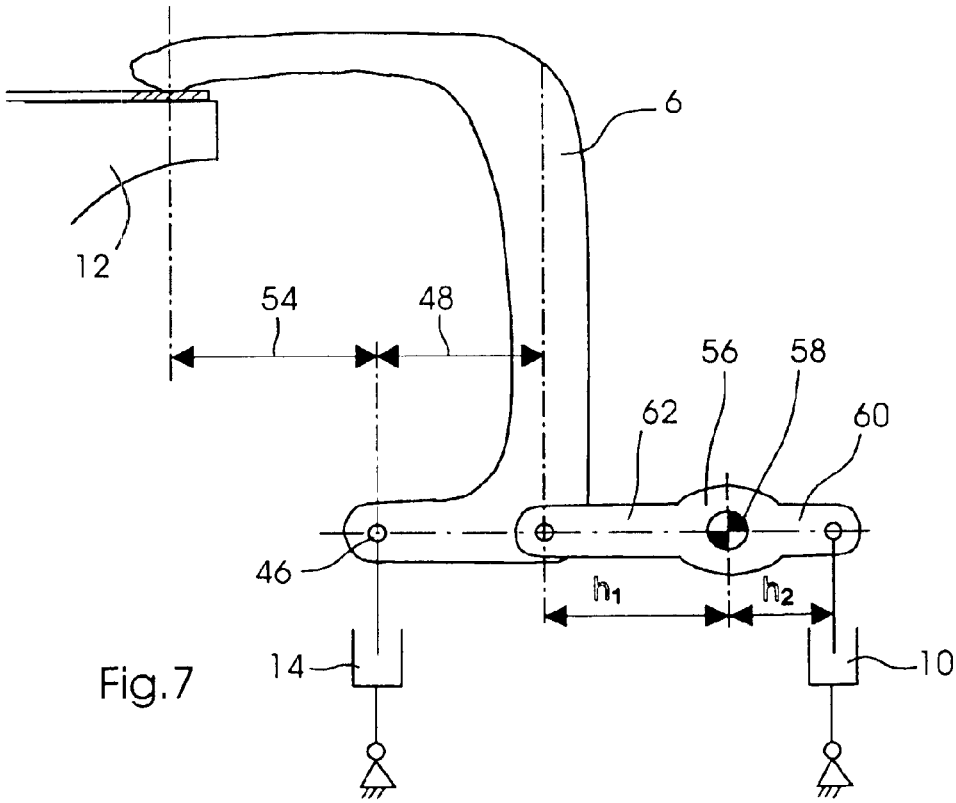
FIG. 7 is a view like that of FIG. 6 showing the embodiment of the invention with the first drive thereof acting upon the gripper via a rocker arm fixed to the frame.

The embodiment of the invention illustrated in FIG. 7 differs from the embodiment according to FIG. 6 in that the first drive 10 acts upon the gripper 6 via a rocker arm 56, the rotational point 58 of the rocker 56 being fixed to the base body 2. The first drive 10 is, in this regard, connected in the manner of a swivel joint to a first lever arm 60 of the rocker 56, and the second lever arm 62 of the rocker 56 acts upon the gripper 6 via a swivel joint, not otherwise specifically illustrated, at a spaced distance 48 from the swivel point 46, in order to swivel the gripper 6 from the closed position into the opened position and the reverse. In the same manner as for the embodiment of FIG. 6, the swivel point 46 in the embodiment according to FIG. 7 is movable up and down by the second drive 46, in order to clamp the sheet 24. Depending upon the choice of the lengths of the first and the second levers 60 and 62, the movement travel/forces can, in this regard, be matched to the respective properties of the first and/or second drives 10 and 14 by appropriate dimensioning of the rocker 56.

Figure 8:
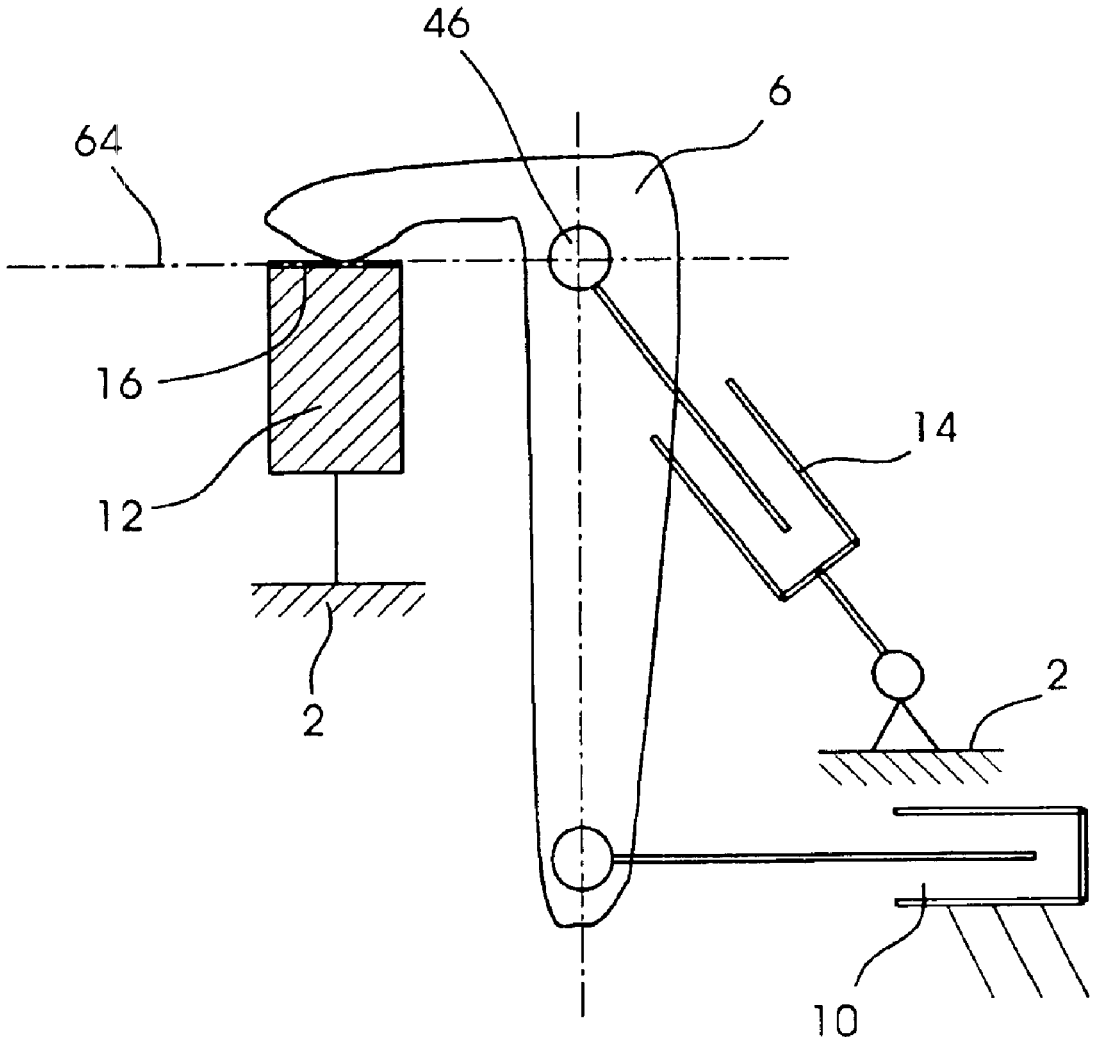
FIG. 8 is a view similar to those of FIGS. 6 and 7, showing another embodiment of the invention, wherein the gripper is constructed as a bellcrank or toggle lever, and which, via a swivel point, is movable by the second drive for positioning at the level of a straight line running through the clamping face of the gripper pad.

In the embodiment of the invention illustrated in FIG. 8, wherein the gripper pad 12 is likewise positioned locally fixed with respect to the base body 2, the first swivel point 46 in the closed position of the gripper 6 is located on a line 64 which extends tangentially through the clamping face 16 of the gripper pad 12.

The second gripper for moving the swivel point 46 is, in this regard, preferably disposed at a 45° angle with respect to the line 64 and is likewise supported on the base body 2 via a swivel joint, otherwise not specifically shown in FIG. 8. In contrast therewith, the first drive 10, which is preferably likewise a linear drive, acts via a lever, which is not otherwise specifically illustrated, and a swivel joint, in a direction extending parallel to the line 64, on the end of the gripper 6 remote from the swivel point 46 and, in this regard, constructed as an L-shaped or angled lever, in such a way that the gripper 6 can be moved from the closed position thereof into the opened position thereof, which is otherwise not illustrated, and the reverse, when the drive 10 is moved, the movement of the tip of the gripper 6 being performed by an appropriate combination of the individual movements of the first drive 10 and the second drive 14, preferably perpendicularly to the line 64, in order to obtain a clamping force acting at least approximately perpendicularly upon the clamping face 16.

According to a further embodiment of the invention, which is not illustrated in the figures, a plurality of grippers 6 and gripper pads 12 are disposed along a row of grippers, each of the grippers 6 and the appertaining gripper pads 12 having their own, separate first and second drives 10 and 14, respectively. In this embodiment, in order to produce a wavy form or corrugation of the leading edge of a sheet, the grippers disposed adjacent one another and appertaining gripper pads are disposed offset in relation to one another along the row of grippers with respect to an imaginary centerline during the production printing operation of the printing press. This results in the advantage that the leading edge of the sheet is stiffened, due to which dog-earing or bending over of the corners, for example when the sheet is guided along the circumferential surface of a transfer cylinder, can effectively be avoided.

According to a further configuration of the invention, it is possible to move the grippers and appertaining gripper pads of a row of grippers of an upstream cylinder by the first drive and/or second drive relative to the grippers of a further row of grippers, which is disposed on a downstream sheet-guiding cylinder, relative to one another in order in this way to eliminate the formation of a corrugation in the sheet leading edge during the sheet transfer. Such a corrugation results, for example, in printing presses of the prior art due to the fact that the gripper pads of the upstream and downstream cylinders are generally set up for a printing material thickness at which the sheet leading edge extends rectilinearly. In the event of a change to a thicker or thinner printing material, because of the comb-type alternate interengagement of the grippers of the upstream and downstream cylinders, an undesired wavy shape or corrugation results from the increased or reduced thickness of the printing material.

We claim:

1. A gripper device in a sheet-processing machine, the gripper device comprising:

a gripper pad having a first clamping face;

a gripper having a second clamping face and being associated with said gripper pad for cooperatively engaging with said gripper pad to produce a clamping force for holding sheets being processed;

a first drive for moving said gripper out of an opened position thereof into a closed position thereof; and a second drive separately operable from said first drive during a production printing operation of the sheet-processing machine;

said first and second drives being operable to position at least one of said gripper and said gripper pad for moving at least one of said first and second clamping faces with said second drive perpendicularly to the other of said first and second clamping faces;

said gripper, in said closed position thereof, being positioned locally in a fixed position with respect to said gripper pad by said first drive, and said gripper pad being movable relative to said gripper by said second drive for clamping the sheets with said gripper closed;

said gripper being movable by said first drive with respect to said gripper pad out of said opened position and into said closed position in a plane extending at least approximately parallel to a transport plane of the sheets.

2. The gripper device according to claim 1, wherein said second drive is a piezo-actuator drive.

3. The gripper device according to claim 1, further comprising a gripper shaft whereon said gripper is mounted fixed against rotation relative thereto, said gripper shaft being lockable in said closed position by said first drive.

4. The gripper device according to claim 3, wherein said first drive is a rotary drive for acting upon an axis of rotation of said gripper shaft for locking, by a stoppage torque thereof, said gripper shaft in said closed position.

5. The gripper device according to claim 3, wherein said first drive is a linear drive for acting through a lever upon an axis of rotation of said gripper shaft for locking, by a stoppage torque of said linear drive, said gripper shaft in said closed position.

6. The gripper device according to claim 3, further comprising a further drive for varying the position of said gripper shaft relative to said gripper pad.

7. The gripper device according to claim 1, further comprising a self-locking mechanism for coupling said first drive with said gripper for locally fixed positioning of said gripper in said closed position.

8. The gripper device according to claim 7, wherein said self-locking mechanism is a toggle-lever mechanism.

9. The gripper device according to claim 1, wherein said first drive is a piezo-actuator.

10. The gripper device according to claim 1, wherein said second drive is a piezo-actuator whereon said gripper pad is disposed.

11. The gripper device according to claim 10, wherein said piezo-actuator is formed by a multiplicity of individual piezo-elements disposed in a stack-shaped manner.

12. The gripper device according to claim 1, further comprising a programmable electronic control device for operating said first and second drives.

13. The gripper device according to claim 12, further comprising a sensor coupled with said control device for measuring a clamping force to act between said gripper and said gripper pad, said second drive being movable via said control device in accordance with signals from said sensor for varying a spaced distance between said gripper pad and said gripper.

14. The gripper device according to claim 13, wherein said sensor is accommodated on said gripper pad.

15. The gripper device according to claim 13, wherein said electronic control device serves for moving said second drive as a function of the signals from said sensor for actively counteracting bouncing of said gripper during said closing operation by effecting a relative change in said distance between said gripper and said gripper pad.

16. A gripper device in a sheet-processing machine, the gripper device comprising:

a gripper pad having a first clamping face;

a gripper having a second clamping face and being associated with said gripper pad for cooperatively engaging with said gripper pad to produce a clamping force for holding sheets being processed;

a first drive for moving said gripper out of an opened position thereof into a closed position thereof; and a second drive separately operable from said first drive during a production printing operation of the sheet-processing machine;

said first and second drives being operable to position at least one of said gripper and said gripper pad for moving at least one of said first and second clamping faces with said second drive perpendicularly to the other of said first and second clamping faces;

said gripper pad being positioned locally in a fixed position, and said first drive and said second drive being mechanically coupled with said gripper for moving said gripper out of said opened position and into said closed position by said first drive, and for moving said gripper into said closed position by said second drive for clamping the sheets at least approximately perpendicularly to said gripper pad.

17. The gripper device according to claim 16, wherein said gripper is swivelable about a swivel point, and said second drive serves to act upon said swivel point for varying a position of said swivel point.

18. A sheet-processing machine, comprising a gripper device including:

a gripper pad having a first clamping face;

a gripper having a second clamping face and being associated with said gripper pad for cooperatively engaging with said gripper pad to produce a clamping force for holding sheets being processed;

a first drive for moving said gripper out of an opened position thereof into a closed position thereof; and a second drive separately operable from said first drive during a production printing operation;

said first and second drives being operable to position at least one of said gripper and said gripper pad for moving at least one of said first and second clamping faces with said second drive perpendicularly to the other said of said first and second clamping faces;

said gripper, in said closed position thereof, being positioned locally in a fixed position with respect to said gripper pad by said first drive, and said gripper pad being movable relative to said gripper by said second drive for clamping the sheets with said gripper closed;

said gripper being movable by said first drive with respect to said gripper pad out of said opened position and into said closed position in a plane extending at least approximately parallel to a transport plane of the sheets.

* * * * *